United States Patent [19]

Kato

[11] 4,399,648

[45] Aug. 23, 1983

[54] METHOD FOR EVALUATION OF BALLOONS OF YARN-LIKE PRODUCTS

[75] Inventor: Hisaaki Kato, Shiga, Japan

[73] Assignee: Murata Kikai Kabushiki Kaisha, Kyoto, Japan

[21] Appl. No.: 276,789

[22] Filed: Jun. 24, 1981

[30] Foreign Application Priority Data

Jun. 26, 1980 [JP] Japan ..... 55-87628

[51] Int. Cl.[3] ..... D01H 13/16; D01H 13/14

[52] U.S. Cl. ..... 57/265; 57/264; 57/81; 57/328

[58] Field of Search ..... 57/81, 264, 265, 293, 57/400, 403, 328, 329, 350; 356/429–431, 231

[56] References Cited

U.S. PATENT DOCUMENTS

| | | | |
|---|---|---|---|
| 3,158,852 | 11/1964 | Schacher | 57/81 X |
| 3,772,524 | 11/1973 | Erbstein | 57/81 X |
| 3,887,814 | 6/1975 | Faulhaber | 356/238 X |
| 4,112,658 | 9/1978 | Morihashi | 57/293 X |
| 4,168,604 | 9/1979 | Mawnhart | 57/265 X |
| 4,183,202 | 1/1980 | Morihashi | 57/350 X |

OTHER PUBLICATIONS

German Patent Publication, No. 2821488, 11/23/78, Electrotex AG.

*Primary Examiner*—Donald Watkins
*Attorney, Agent, or Firm*—Moonray Kojima

[57] ABSTRACT

A method for evaluation of balloons of yarn-like materials. Ballooning of yarn-like materials is converted to an electric signal, the electric signal is amplified and the electric signal is analyed by a Fourier analyzer to know respective frequency components and voltage amplitude components which show the condition of ballooning.

3 Claims, 14 Drawing Figures

METHOD FOR EVALUATION OF BALLOONS OF YARN-LIKE PRODUCTS

FIELD OF THE INVENTION

The present invention relates to a method for evaluation of balloons of ballooning yarn-like products, and more particularly, the present invention relates to a method for evaluation of balloons of yarns in the process for obtaining spun yarns by a pneumatic spinning method such as an open end spinning method or a false-twisting spinning method.

BACKGROUND OF THE INVENTION

The steps of preparing spun yarns according to the pneumatic spinning method are quite different from the steps of preparing spun yarns according to the ring spinning method except the step using a drafting device, and in the pneumatic spinning method, a drafted sliver is ballooned by using a fluid jet nozzle and twists are imparted when balloons are formed, and spun yarns are thus obtained.

Accordingly, the structure of a yarn obtained according to the pneumatic spinning method is different from the structure of a yarn obtained according to the ring spinning method. In the pneumatic spinning method, the properties of yarns, such as uniformity, strength and feeling, are greatly influenced by balloon factors such as the rotation number and diameter of balloons, and the pneumatic spinning method is inferior to the ring spinning method in the stability of the yarn properties.

Since the above-mentioned balloon factors are changed comprehensively by spinning conditions, for example, the nozzle structure (fluid jetting angle, inner diameter and the like), the fluid pressure, the spinning tension and the drafting unevenness, analysis of factors changing the ballooning state is very difficult, and even at the present, spinning conditions are independently determined in respective plants according to empirical laws while a method for analyzing these factors is not established.

SUMMARY OF THE INVENTION

An object of the present invention is to provide a method for evaluating balloons in the process for producing spun yarns by means of a pneumatic yarn spinning.

According to the present invention, a ballooning phenomenon is detected as an electric signal by a detector comprising a luminous diode and photo transistor and the detected electric signal is subjected to Fourier transformation by using a Fourier analyzer to be spectrally analyzed to respective frequency components and voltage amplitude components so that optimum spinning conditions are set by analyzing the respective balloon characteristics.

The method of the present invention satisifes all the following conditions required in the detecting zone;

(a) a very fine yarn-like product can be detected and a sufficient output signal can be produced;

(b) the detector is fully responsive to a high-speed rotation of a balloon;

(c) the measuring zone is narrow and the detector has a small size; and (d) drifts are small and detection can be accomplished stably even if the measurement is conducted for a long time.

Since the ballooning phenomenon is analyzed based on results obtained by the present invention, spinning conditions capable of forming an optimum balloon can be set.

Furthermore, by analyzing the ballooning phenomenon in the actual production process, the spinning conditions having influences on the yarn properties such as uniformity, strength, formation of fluffs and feelings can be known.

DETAILED DESCRIPTION OF THE INVENTION

The present invention will now be described in detail with reference to embodiments illustrated in the accompanying drawings.

Figure 1:
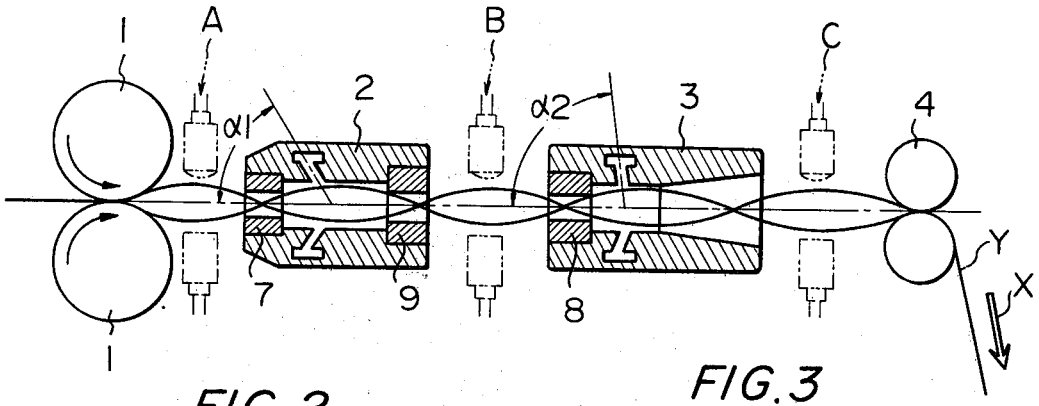
FIG. 1 is a schematic diagram illustrating one embodiment of the process for the production of spun yarns.

FIG. 1 illustrates one embodiment of the process for preparing spun yarns according to the pneumatic spinning method. Referring to FIG. 1, a sliver drafted by a drafting device and delivered from a front roller 1 is passed through two fluid jet nozzles 2 and 3 rotating in directions opposite to each other, and when the sliver is being passed through the two fluid jet nozzles 2 and 3, the sliver is twisted and a yarn Y is formed. The yarn Y is wound on a winding bobbin not shown in the drawings through a take-up roller 4.

Figure 2:
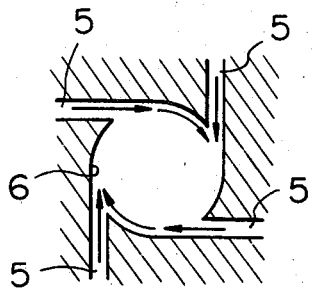
FIG. 2 is a detailed view showing the nozzle portion.

As shown in FIG. 2, in each of the fluid jet nozzles 2 and 3, a fluid jet hole 5 is opened slantingly at an angle $\alpha 1$ or $\alpha 2$ to the yarn running direction in the tangential direction to the inner circumference of a yarn passage pipe 6 and in the axial direction thereof. A turning and swirling stream of a fluid flowing in the yarn running direction is produced in the yarn passage pipe 6 by a fluid jetted into the yarn passage pipe 6 from the fluid jetting hole 5. At this time, rotation, that is, revolution and turning, is given to the fiber bundle passing through the fluid jet nozzles 2 and 3, and the fiber bundle is positively guided in the yarn running direction (indicated by an arrow X).

Since the first fluid jet nozzle 2 exerts a function different from the function of the second fluid nozzle 3, the inclination angles $\alpha 1$ and $\alpha 2$ of the fluid jetting holes of the fluid jet nozzles 2 and 3 are different from each other. More specifically, the first fluid jet nozzle 2 exerts functions of sucking the fiber bundle delivered from the front roller 1 into the first fluid jet nozzle 2 and turning the fiber bundle, and the second fluid jet nozzle 3 exerts a function of imparting revolution to the fiber bundle, that is, imparting twists to the fiber bundle, though it similarly exerts a function of turning the fiber bundle. From the foregoing explanation, it will readily be understood that good results are obtained when the inclination angle $\alpha 1$ is smaller than the inclination angle $\alpha 2$. From the results of the experiments, it has been confirmed that better results are obtained when the inclination angle $\alpha 1$ is about 48° and the inclination angle $\alpha 2$ is about 90°.

The inclination angles $\alpha 1$ and $\alpha 2$ have important influences on the rotation number of the balloon. As the inclination angles become close to 90°, the rotation number of the balloon is increased. Accordingly, rotation numbers of balloons produced between the front roller 1 and the takeup roller 4 differ from one another, and especially between the first and second fluid jet nozzles, balloons rotating in opposite directions interfere with each other, and balloon variations readily become conspicuous.

Furthermore, the balloon rotation number is changed according to the inner diameters of the yarn passage pipes 6 of the fluid jet nozzles 2 and 3, the inner diameters of balloon control rings 7 and 8 arranged in the yarn introduction portions of the first and second fluid jet nozzles 2 and 3 and the inner diameter of a twist regulating pipe 9 arranged in the yarn introduction portion of the first fluid jet nozzle 2, especially the inner diameter of the twist regulating pipe 9 arranged at a position where balloons rotating in opposite directions interfere with each other. Incidentally, not only the balloon rotation number, but also the balloon wavelength and amplitude are influenced by the inner diameters of the yarn passage pipes 6, balloon control rings 7 and 8 and twist regulating pipe 9.

The above-mentioned balloon rotation number and balloon diameter are always changed according to the position and time, and it is not too much to say that the yarn properties, such as uniformity, strength and feeling, and influenced by these balloon variations. Accordingly, in order to improve the yarn quality, it is most important to analyze phenomena of variations of balloons.

Figure 3:
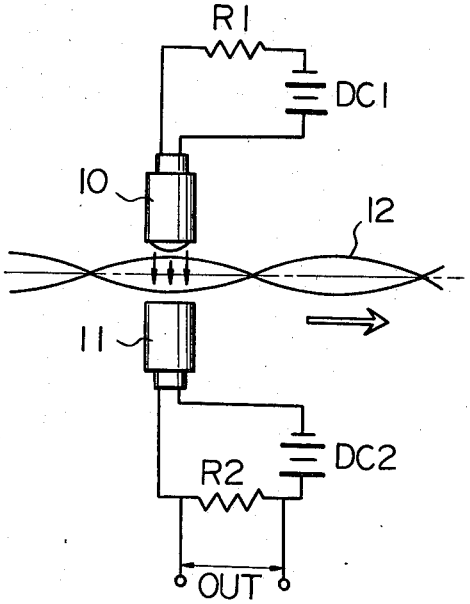
FIGS. 3, 4 and 5 are diagrams illustrating the detecting zone and detecting method.

A detector for detecting such balloon variations is illustrated in FIG. 3. It is indispensable that this detector should satisfy at least the conditions described below. More specifically, the detector can detect a yarn-like product which rotates at a high speed and is fully responsive to variations of this high-speed rotation. Furthermore, this detector should be a small-sized detector capable of measuring balloons from the outside during the actual production of spun yarns. In other words, since the ballooning phenomenon differs according to the spinning conditions, the detector should perform measurements in the actual production process or the same model as the actual production process. Moreover, even if the measurement is conducted for a long time, drifts are small and detection can be accomplished stably. As the detector satisfying the foregoing requirements, a detector comprising a luminous diode and a photo transistor is most preferred.

Incidentally, even by using a detector of the electrostatic capacity type, for example, a condenser, detection is possible.

The method using this detector is a kind of the so-called photoelectric conversion method in which the quantity of light emitted from a luminous diode 10 is detected by a photo transistor 11 and the detected light quantity is converted to an electric quantity. This detecting method has higher sensitivity and response characteristic than the photoelectric conversion method customarily adopted for measurement of fluffs and the like.

When a fiber bundle forming a balloon 12 passes through the zone of the above detector, a part of light emitted from the luminous diode 10 is shaded, and the change of the quantity of light by this interception is detected by the photo transistor 11 and analyzed by a Fourier analyzer described hereinafter.

Figure 4:
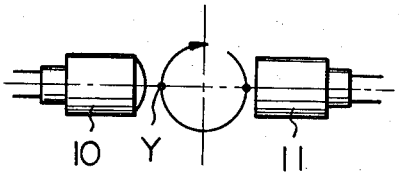
Figure 5:
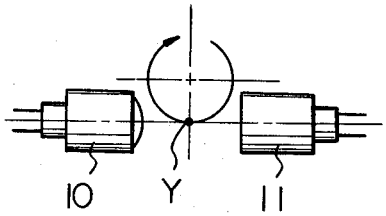
Figure 6:
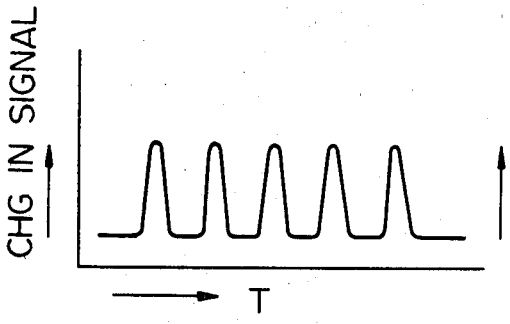
FIGS. 6, 7 and 8 are diagrams illustrating signal waves.
Figure 7:
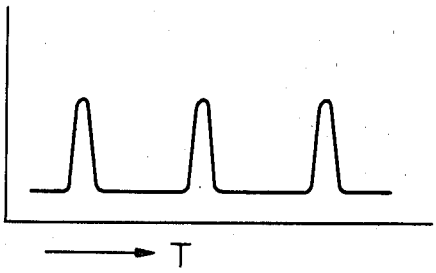

The frequency detected by the detector is varied according to the measurement method. For example, the wave form of signals detected when the luminous diode and photo transistor are arranged so that they confront each other with the center of the balloon center being substantially as the center between the two elements as shown in FIG. 4 is different from the wave form of signals detected when the luminous diode and photo transistor are arranged so that they confront each other substantially on the tangential line on the balloon circle as shown in FIG. 5. In case of the measurement method shown in FIG. 4, a wave form as shown in FIG. 6 appears, and in case of the measurement method shown in FIG. 5, a wave form as shown in FIG. 7 appears. However, the frequency measured in one method is $\frac{1}{2}$ of the frequency measured in the other method or 2 times the frequency measured in the other method, and the measurement results are not different between the two methods.

In FIGS. 6 and 7, ideal signal wave forms are shown based on the supposition that the balloon 12 is not changed at all. If such balloon is always obtained, Fourier analysis described below need not be performed at all.

In the actual production process, however, balloon variations are always caused even under the same spinning conditions, and these balloon variations are drastically changed by changes of the spinning conditions such as the structures of the fluid jet nozzles, 2, 3 for example, the inclination angles $\alpha 1$ and $\alpha 2$ of the jet holes 5, the inner diameters of the yarn passage pipes 6, the inner diameters of the balloon control rings 7 and 8 and the inner diameter of the twist regulating pipe 9, the pressure of the jetted fluid, the spinning tension between the front roller 1 and take-up roller 4 and the yarn unevenness produced at the preliminary spinning step or in the drafting device. Accordingly, under the same spinning conditions, certain balloon variations can take place. However, an optimum yarn Y can be obtained by spinning when the above-mentioned respective spinning conditions are selected and combined so that balloon variations are reduced to minimum levels stably. In order to determine optimum spinning conditions, it is necessary to analyze the ballooning phenomenon moment by moment in the actual production process.

Figure 8:
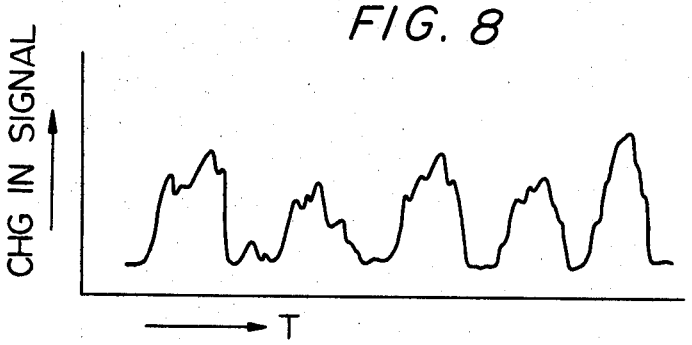
Figure 9:
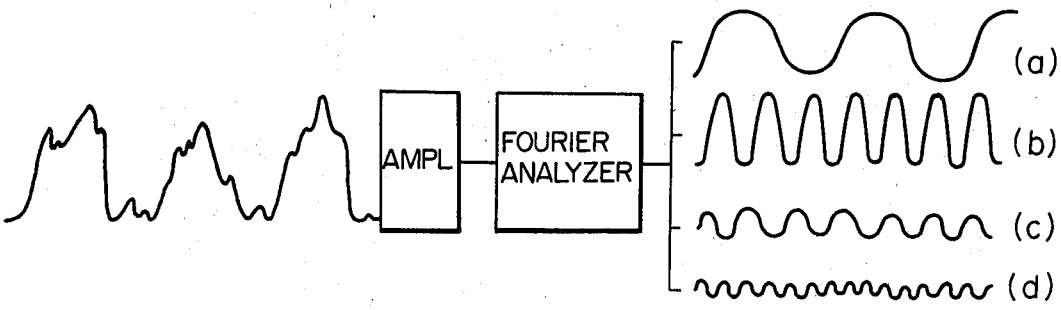
FIGS. 9, 10 and 11 are diagrams illustrating the balloon analyzing method.

FIG. 8 shows a wave form of combined balloon signals. If only this signal wave form is seen, it only is recognized that balloon variations take place. Accordingly, it is necessary to analyze the signal wave form and clarify causes of the variations. The method for analyzing the signal wave form is shown in FIG. 9. The signal wave form shown in FIG. 8, which has been detected by the above-mentioned detector, is amplified to a signal wave form most suitable for AD converter by amplifier, and the amplified combined electric signals are spectrally analyzed to respective frequency components and voltage amplitude components (a), (b), (c), (d) by a Fourier analyzer.

Figure 10:
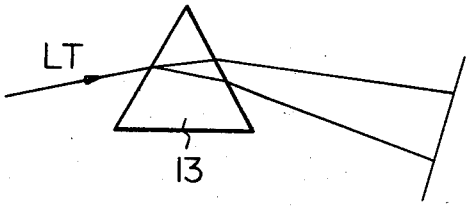

As shown in FIG. 10, the basic principle of analysis of electric signals by the Fourier analyzer resembles the principle of seeing seven color spectra by passing the sunlight through a triangular prism 13.

Figure 11:
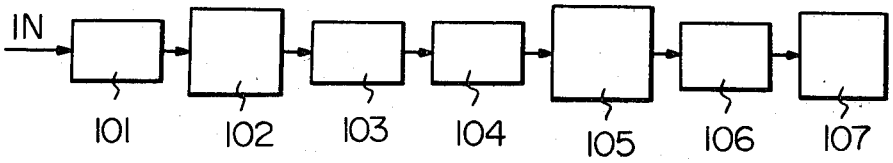

FIG. 11 is a block diagram of the Fourier analyzer. Referring to FIG. 11, a signal is first introduced into an amplifier 101 and is then passed through an area-effect preventing low-pass filter 102 to effect AD conversion 103, and the converted signal is stored in a data memory 104. The data stored in the data memory 104 are subjected to operations such as averaging, correlation and Fourier conversion by a data processor 105 and then to an output processing 106, and processed data are displayed on an indicator 107.

More specifically, when a yarn balloon passes through the detecting zone including the luminous diode 10 and the photo transistor 11, the ballooning phenomenon is converted to an electric quantity and is detected as an electric signal. The detected electric signal, that is, the combined signal wave form, is passed through the amplifier and analyzed to respective frequency and voltage amplitude components (a), (b), (c) and (d) shown in FIG. 8 by the Fourier analyzer, and these components (a), (b), (c) and (d) are displayed.

TABLE 1

| | spinning condition |
|---|---|
| yarn count | Ne 35 |
| spinning velocity | 150 m/min |
| feeding ratio | 0.98 |
| pressure of fluid | |
| first nozzle | 4 kg/cm$^2$ |
| second nozzle | 4 kg/cm$^2$ |

Figure 12:
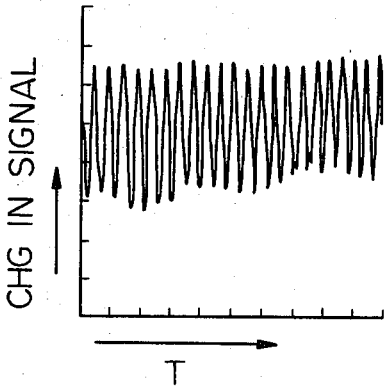
FIGS. 12, 13 and 14 are diagrams illustrating the experimental results.
Figure 13:
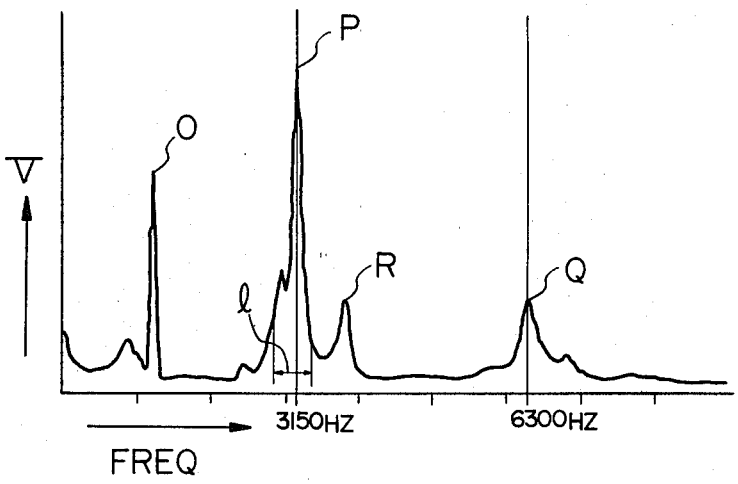

The results of experiments conducted under conditions shown in Table 1 are shown in FIGS. 12 and 13. The wave form of signals detected by the detector is shown in FIG. 13, and the results of analysis of this wave form are shown in FIG. 13. From the wave form shown in FIG. 12, it can be conjectured that balloon variations take place, but it is impossible to analyze what variations actually take place. From the analysis results shown in FIG. 13, the actual state of the ballooning phenomenon can precisely be grasped. More specifically, from the analysis results shown in FIG. 13, it is seen that the frequency of the balloon rotation number is highest at about 190,000 r.p.m. (3150 Hz×60 c/s) (point P) and deviations (l) of the rotation number appear before and after this point.

The rotation number at the point Q has a frequency 2 times the frequency at the point P. As pointed out hereinbefore, in the method shown in FIG. 5, one rotation of the balloon is detected as one signal, and in the method shown in FIG. 4, one rotation of the balloon is detected as two signals. Accordingly, it is seen that the above phenomenon indicates that the yarn balloon moves in the vertical direction.

The frequency of the rotation number at the point R is substantially the same as the frequency of the rotation number at the point Q.

The frequency of the rotation number at the point O is inherent to the measurement method. More specifically, in FIG. 1, the measurement can be made at a point A between the front roller 1 and the first fluid jet nozzle 2, at a point B between the first fluid jet nozzle 2 and the second fluid jet nozzle 3 or at a point C between the second fluid jet nozzle and the take-up roller 4, and the results shown in FIG. 13 are those obtained by conducting the measurement at the point A according to the method shown in FIG. 5. At the above-mentioned point O, the results obtained by detection of the light of the detector reflected from concave and convex grooves formed at predetermined intervals on the peripheral surface of the front roller 1 are shown. Accordingly, if these detection results are analyzed, it becomes possible to know the rotation number of the front roller 1, variations of this rotation and the spinning speed of the fiber bundle delivered from the drafting device.

Figure 14:
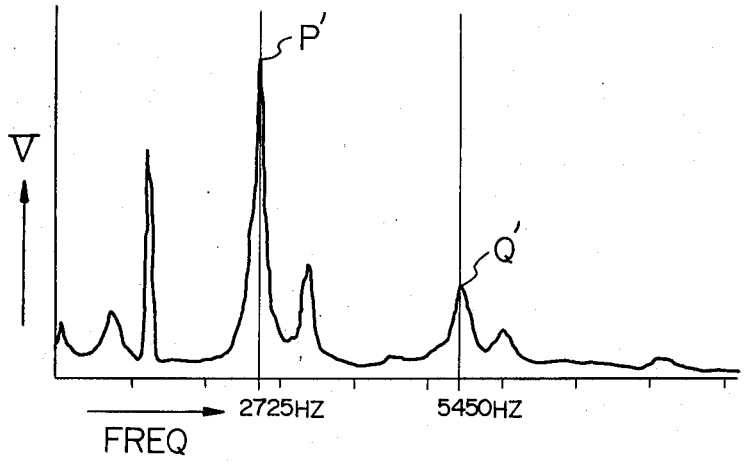

FIG. 14 shows the results of spectral analysis obtained when the experiment is carried out under the same conditions as shown in Table 1 except that the pressure of the fluid jetted from the first fluid jet nozzle is reduced to 3 kg/cm$^2$. From the results shown in FIG. 14, changes of the balloon owing to changes of the pressure of the fluid jetted from the first fluid jet nozzle 2 can readily be understood. The balloon rotation number at the point P′ is about 160,000 r.p.m. (2725 Hz×60 c/s) and the rotation number appearing at the point Q′ is two times the rotation number appearing at the point P′.

As will be apparent from the foregoing illustration, if various spinning conditions such as the spinning speed, the feed rate, the spinning tension, the fluid pressure and the fluid jet nozzle structure are set in various manners and the results of experiments conducted under these various spinning conditions are analyzed, it is possible to determine spinning conditions capable of producing an optimum ballooning phenomenon.

In the foregoing embodiment, the ballooning phenomenon in the process for production of spun yarns is analyzed and evaluated. The present invention can be applied to ballooning phenomena of all of ballooning yarn-like products.

As will be apparent from the foregoing description, according to the present invention, a ballooning phenomenon of a yarn in the process for production of spun yarns is detected as an electrical signal, the thus detected signal, that is, a combined signal wave form, is analyzed to respective frequency components and voltage amplitude components, and the ballooning phenomenon is analyzed based on these analysis results and spinning conditions capable of forming an optimum balloon can be set. Furthermore, by analyzing the ballooning phenomenon in the actual production process, the spinning conditions having influences on the yarn properties such as uniformity, strength, formation of fluffs and feeling can be known.

What is claimed is:

1. A method for evaluation of balloons of yarn-like materials, which comprises converting a balloon of a ballooning yarn-like materials to an electric signal by a detector comprising a luminous diode and a photo transistor, amplifying the electric signal to an AD convertible signal to effect Fourier transformation, spectrally analyzing said electric signal to respective frequency components and voltage amplitude components, and evaluating the balloon of the yarn-like material based on the analyzed spectra, wherein said balloon of the yarn-like material is a balloon of a fiber bundle which is produced in a pneumatic yarn spinning method comprising the steps of drafting a sliver, delivering the sliver by front rollers, passing it through fluid jet nozzles to be twisted and produced a spun yarn and being wound on a winding bobbin through take-up rollers, and said converting process of the balloon to the electric signal is performed between the fron rollers and the take up rollers.

2. A method for evaluation of balloons as claimed in claim 1, wherein said converting process of the balloon to the electric signal is performed between the front rollers and the fluid jet nozzles.

3. A method for evaluation of balloons as claimed in claim 1, wherein said evaluation of balloons is performed to know balloon rotation number, deviations of the balloon rotation number, movement of balloons in the vertical direction, rotation number of the front roller and drafting speed of the fiber fundle from a drafting zone.

* * * * *